US005283915A

United States Patent [19]

Idland et al.

[11] Patent Number: 5,283,915

[45] Date of Patent: Feb. 8, 1994

[54] POWER PACKAGE FOR SPA APPARATUS

[75] Inventors: Carsten H. Idland; John M. Popovich, both of Los Angeles; Roc V. Fleishman, Venice, all of Calif.

[73] Assignee: Softub, Inc., Chatsworth, Calif.

[21] Appl. No.: 927,005

[22] Filed: Aug. 10, 1992

[51] Int. Cl.[5] ..... E03C 1/084; E04H 4/12

[52] U.S. Cl. ..... 4/541.1; 4/506; 4/509; 417/423.14

[58] Field of Search ..... 4/541.1, 541.2, 541.3, 4/541.4, 541.5, 541.6, 568, 492, 506, 507, 509, 546, 490, 508; 417/423.15, 423.14, 423.1; 206/319, 139; 403/903; 138/112

[56] References Cited

U.S. PATENT DOCUMENTS

| | | | |
|---|---|---|---|
| 2,734,459 | 2/1956 | Zimsky . | |
| 3,337,384 | 8/1967 | Wright . | |
| 3,695,781 | 10/1972 | LaBarber | 417/423.14 |
| 3,720,964 | 3/1973 | Thomson . | |
| 3,918,479 | 11/1975 | Perl | 417/367 |
| 3,943,580 | 3/1976 | Carter | 4/172.15 |
| 4,020,986 | 5/1977 | McAtee | 206/139 |
| 4,118,814 | 10/1978 | Holtom | 9/6 |
| 4,233,694 | 11/1980 | Janosko et al. | 4/541.2 |
| 4,699,288 | 10/1987 | Mohan | 220/3 |
| 4,806,083 | 2/1989 | LaGrange et al. | 417/423.14 |
| 4,843,659 | 7/1989 | Popovich et al. | 4/541.1 |
| 4,857,112 | 8/1989 | Fränninge | 4/541.1 |
| 4,858,254 | 8/1989 | Popovich et al. | 4/541.1 |
| 4,981,543 | 1/1991 | Popovich et al. | 4/541.1 |
| 5,092,951 | 3/1992 | Popovich et al. | 4/541.1 |
| 5,172,754 | 12/1992 | Graber et al. | 4/541.2 |
| 5,199,116 | 4/1993 | Fischer | 4/541.2 |

FOREIGN PATENT DOCUMENTS

| | | | |
|---|---|---|---|
| 116231 | 8/1984 | European Pat. Off. | 4/541.3 |
| 2729516 | 4/1979 | Fed. Rep. of Germany . | |
| 2518717 | 6/1983 | France . | |
| 1381723 | 1/1975 | United Kingdom . | |
| 90522 | 5/1985 | Japan | 4/541.1 |
| 63-095 | 4/1988 | Japan | 4/541.3 |
| 164323 | 6/1990 | Japan | 4/541.1 |
| 280670 | 7/1952 | Switzerland | 4/541.3 |
| 904763 | 8/1962 | United Kingdom | 4/584 |

*Primary Examiner*—Henry J. Recla
*Assistant Examiner*—Charles R. Eloshway
*Attorney, Agent, or Firm*—William W. Haefliger

[57] ABSTRACT

Tub apparatus comprising a foamed, resiliently compressible, plastic tub wall having an inner side and an outer side, the tub having an interior to receive liquid, and ports extending through the side wall; a plastic pack having a cavity formed therein; a pump unit received in the cavity and protectively enclosed by the plastic pack; and tubular duct structure connected with the pump unit and extending from the cavity to the ports for circulating liquid between the tub interior and the pump unit.

57 Claims, 13 Drawing Sheets

FIG. 26.
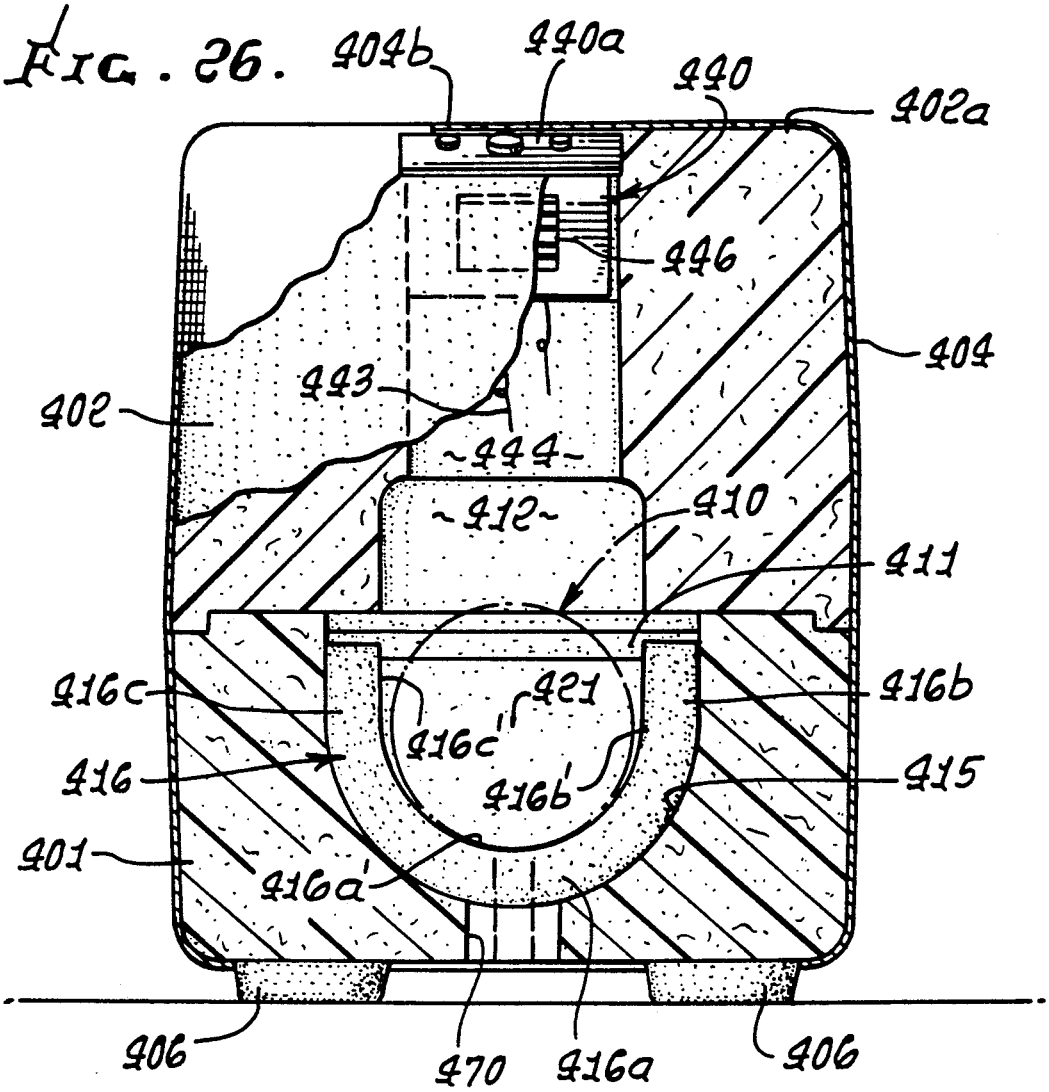
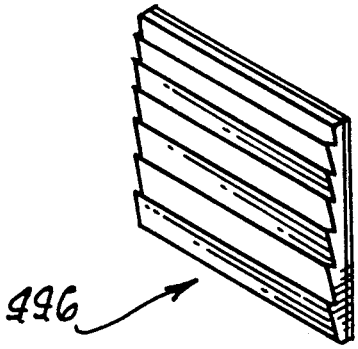
FIG. 27.

POWER PACKAGE FOR SPA APPARATUS

BACKGROUND OF THE INVENTION

This invention relates generally to hot tubs or spas, and more particularly to a low-cost, lightweight, insulated, semi-rigid plastic spa, which is easily portable, and hot water supply means therefor.

Conventional hot tubs are heavy, non-portable, and expensive in their construction; also, excessive electrical and heat energy is required for their operation. There is need for a greatly improved spa structure with the unusual advantages in construction, modes of operation, use and transport, and results, as are now made possible by the present invention, as will appear.

There is also need for pump units, and housings for same, to be used in combination with such hot tubs or spas

SUMMARY OF THE INVENTION

It is a major object of the invention to provide a pump unit for hot tub or spa meeting the above needs. Basically, the invention comprises:

a) a foamed, resiliently compressible, plastic tub wall having an inner side and an outer side, the tub having an interior to receive liquid, and ports extending through the side wall, b) a plastic pack having a cavity formed therein, c) a pump unit received in the cavity and protectively enclosed by the plastic pack, d) and tubular duct means connected with the pump unit and extending from the cavity to the ports for circulating liquid between the tub interior and the pump unit.

As will be seen, the plastic pack is typically located at the exterior of the tub wall, the ports being at upper and lower elevations in the tub side wall; the pack preferably including a plastic base and a plastic cover received on the base, the pump received in the cavity in the base.

It is another object to provide the base and cover of the pack to consist of lightweight, foamed plastic material, with a flexible jacket fitted closely about the base and cover, with the liquid or water supply and return ducting extending through openings in the jacket. In this regard, the pump unit may be seated or supported in a U-shaped protective fiberglass pad that distributes loading to the foamed plastic base and helps absorb any vibration associated with motor and/or pump operation.

The shunt duct surrounding the motor housing is also confined by the pad, as will be seen, that duct serving as a motor heat transfer means to water to be heated and delivered to the pool or spa.

Yet another object is to provide motor and/or pump control means in a recess in the foamed plastic cover, at operator level.

The tub apparatus itself typically and advantageously comprises:

a tensile liner adjacent the tub wall side and characterized in that it resists outward expansion in response to loading exerted by liquid filled into the tub interior, and ports extending through the side wall and liner for circulating liquid between the interior of the tub and the exterior thereof, i.e, to the pump unit in the plastic pack.

The method of constructing the tub apparatus basically includes:

a) providing a foamed, resiliently compressible, plastic tub wall having an inner side and an outer side, the tub having an interior to receive liquid, and ports extending through said side wall, b) providing a plastic pack having a cavity formed therein, c) providing a pump unit and seating said unit in said cavity to be protectively enclosed by the plastic pack, d) and providing tubular duct means connected with said pump unit and extending said ducting from said cavity to said ports for circulating liquid between the tub interior and the pump unit.

The pack is typically provided with a base and a cover; a flexible jacket is located about these elements; the pump may be seated on a densified layer of plastic; and controls may be located in the cover.

These and other objects and advantages of the invention as well as the details of an illustrative embodiment, will be more fully understood from the following specification and drawings, in which:

DRAWING DESCRIPTION

Figure 6:
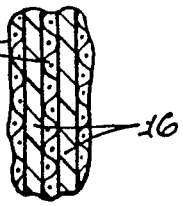
Figure 6A:
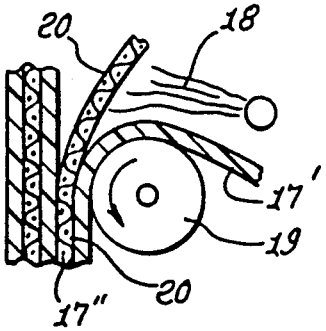
Figure 7A:
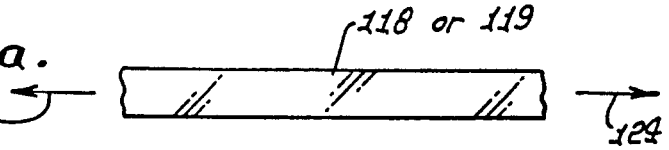
Figure 7B:
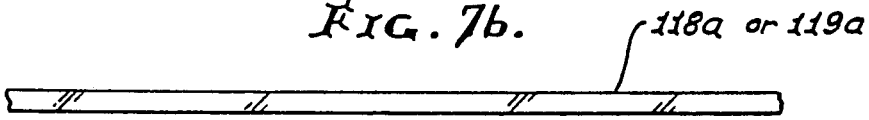
Figure 8:
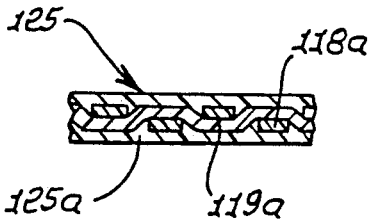
Figure 9:
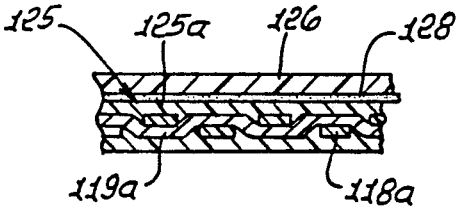
Figure 10:
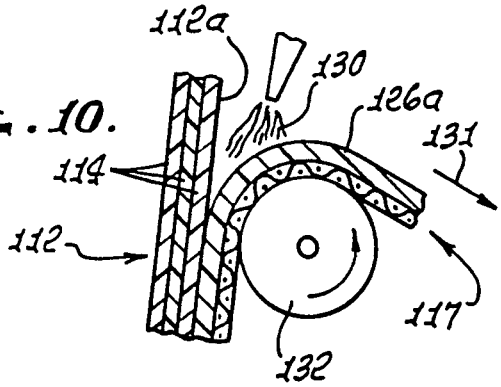
Figure 11:
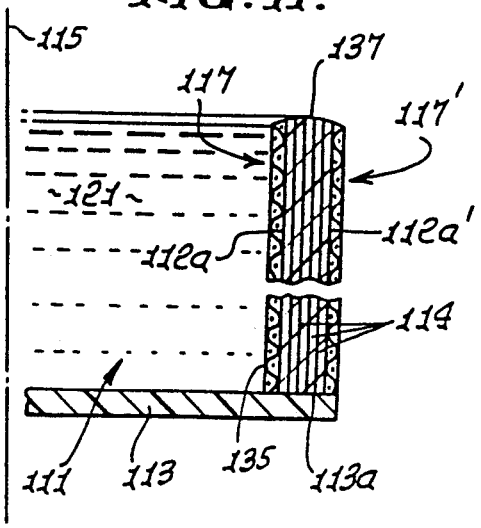
Figure 11A:
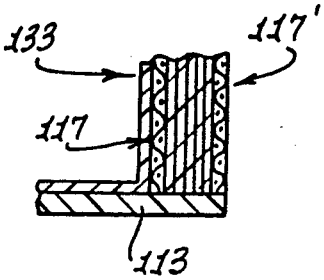
Figure 12:
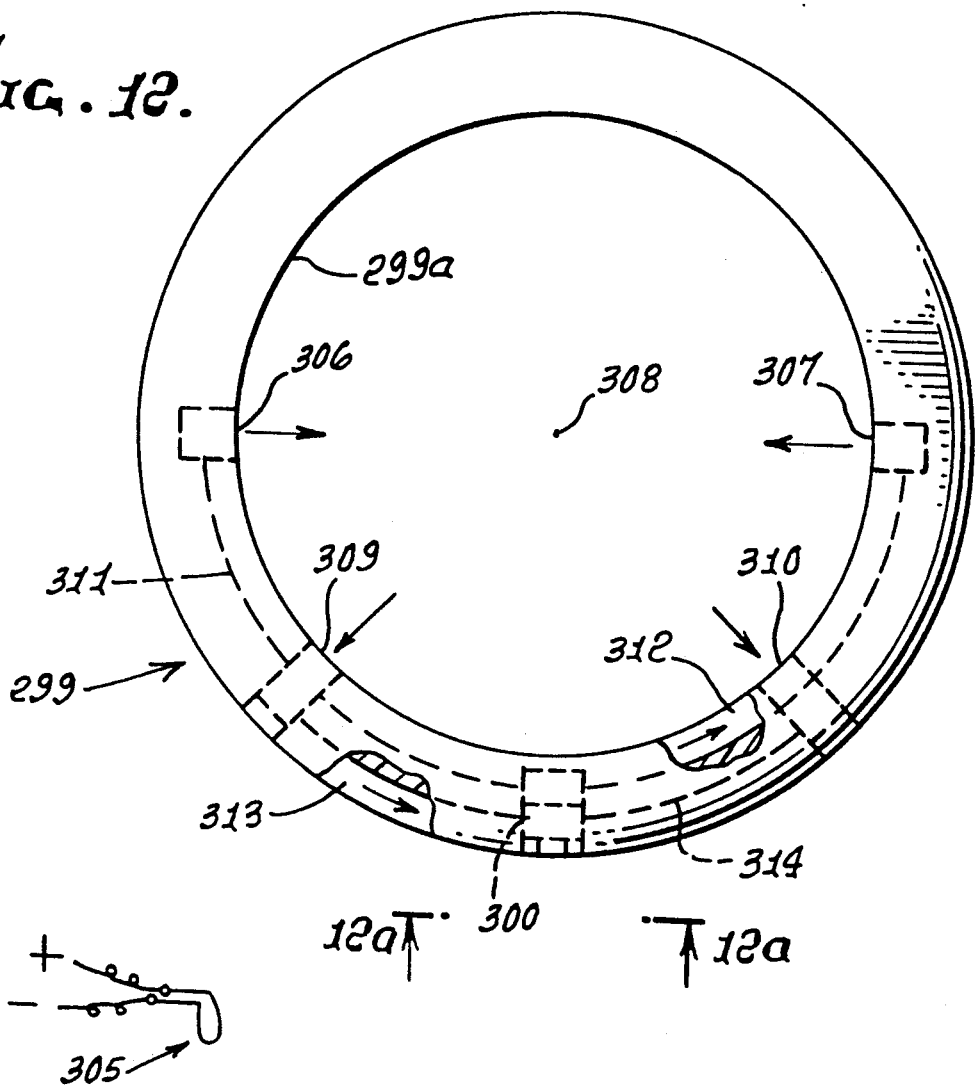
Figure 12A:
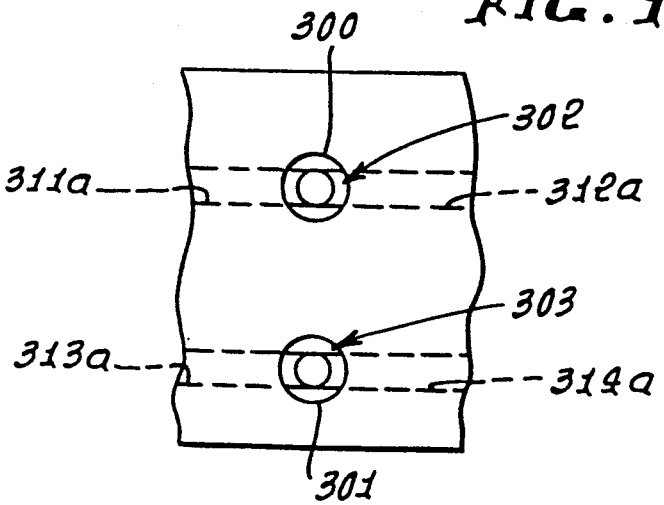
Figure 13:
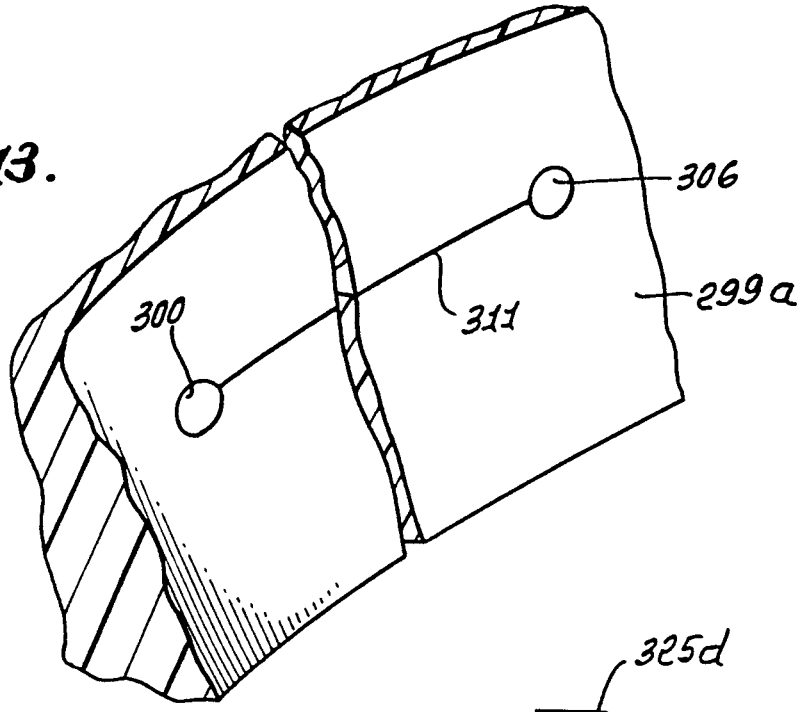
Figure 16:
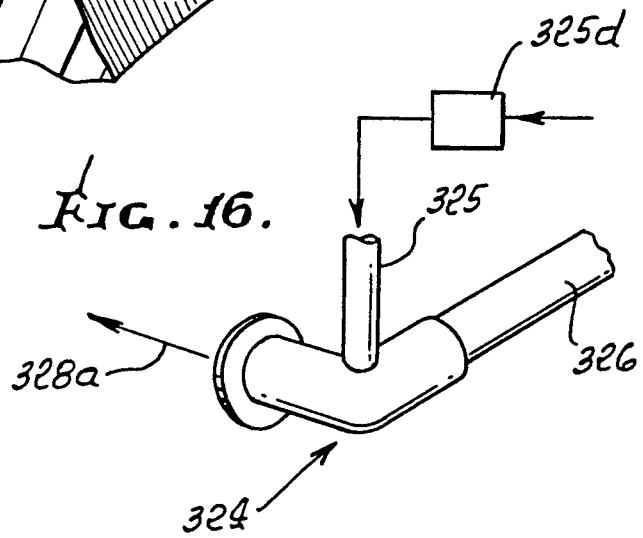
Figure 16A:
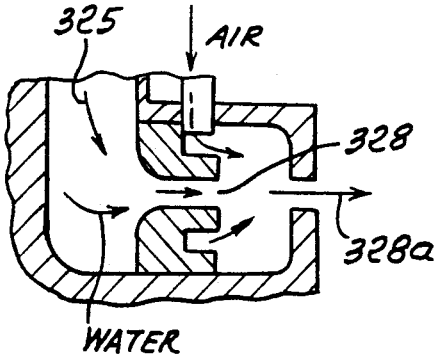
Figure 17:
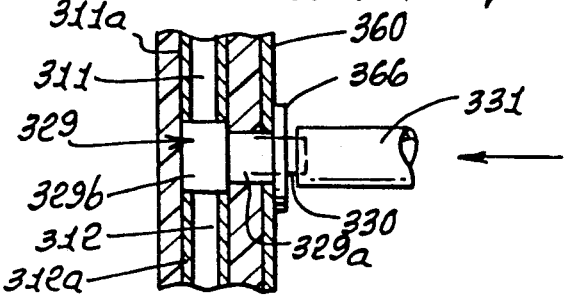
Figure 14A:
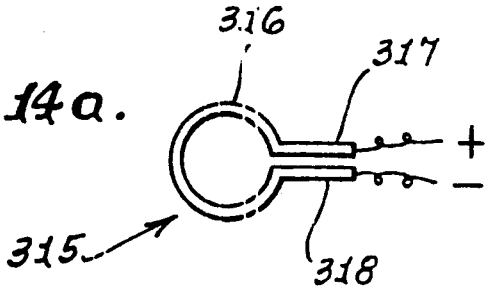
Figure 14:
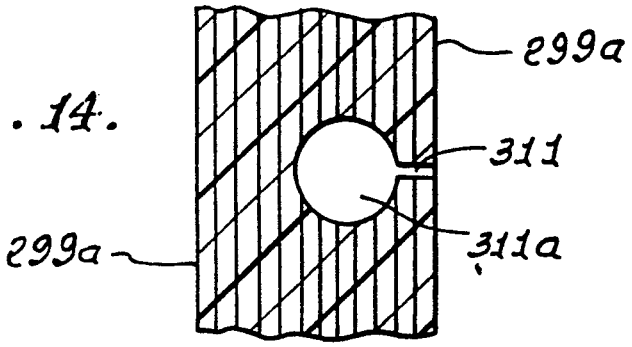
Figure 15:
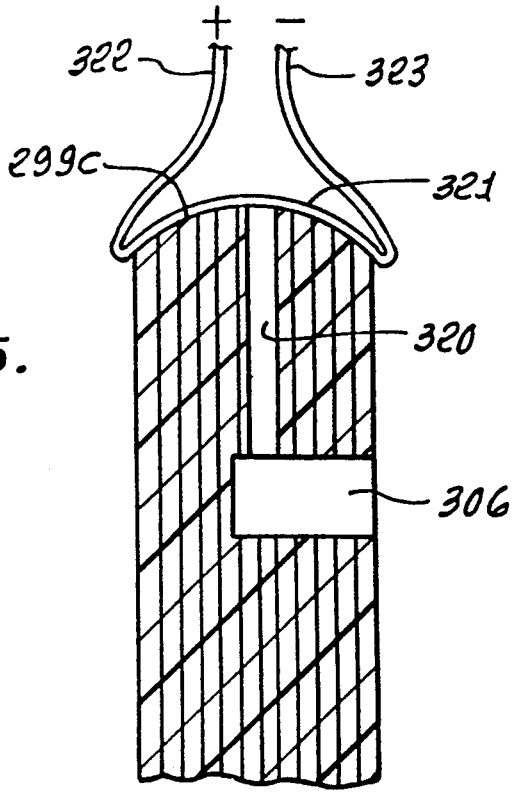
Figure 19:
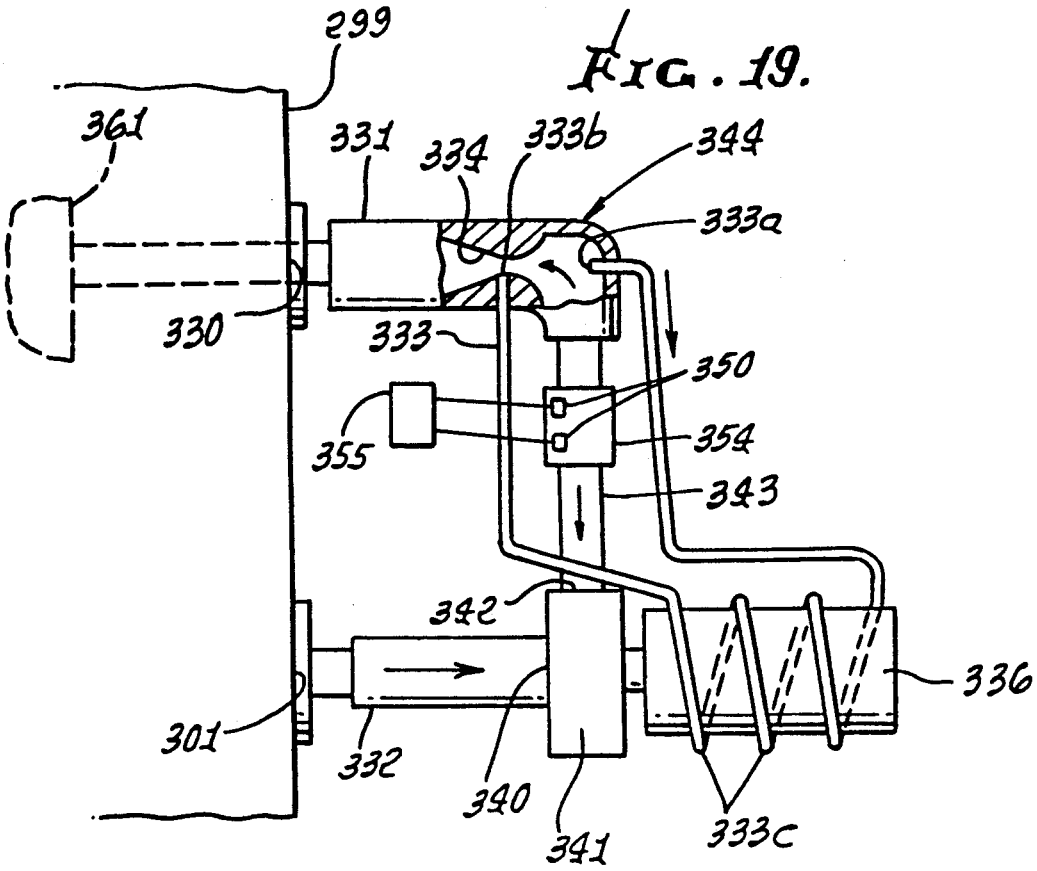
Figure 19A:
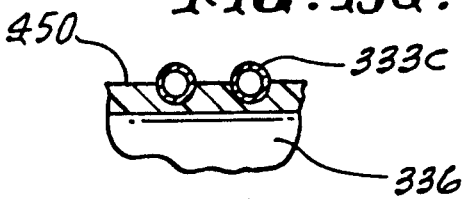
Figure 18:
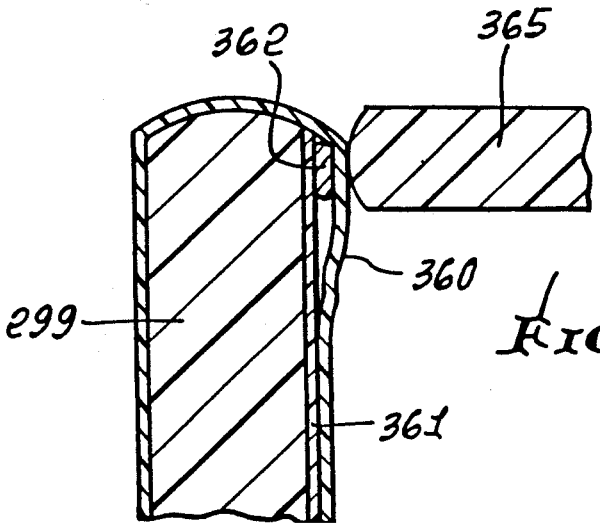
Figure 20:
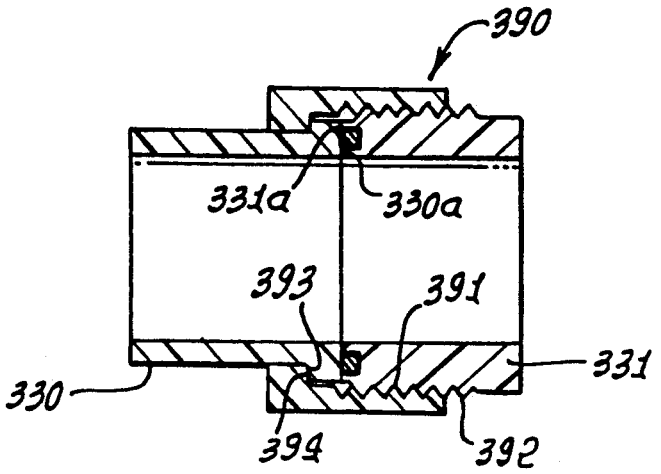
Figure 21:
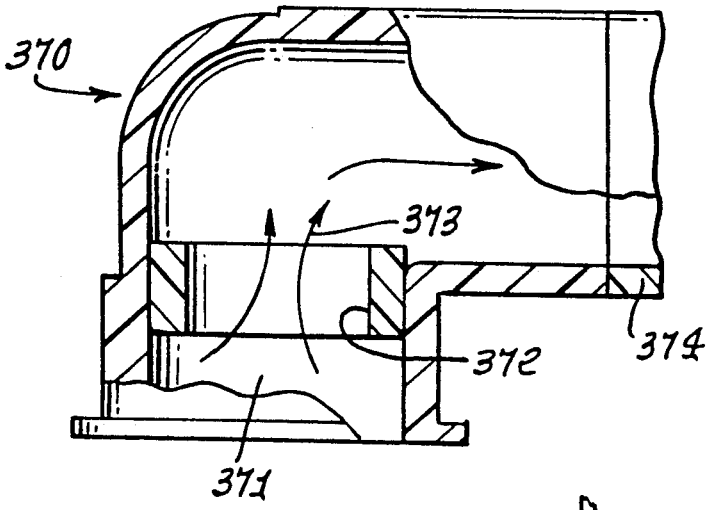
Figure 22:
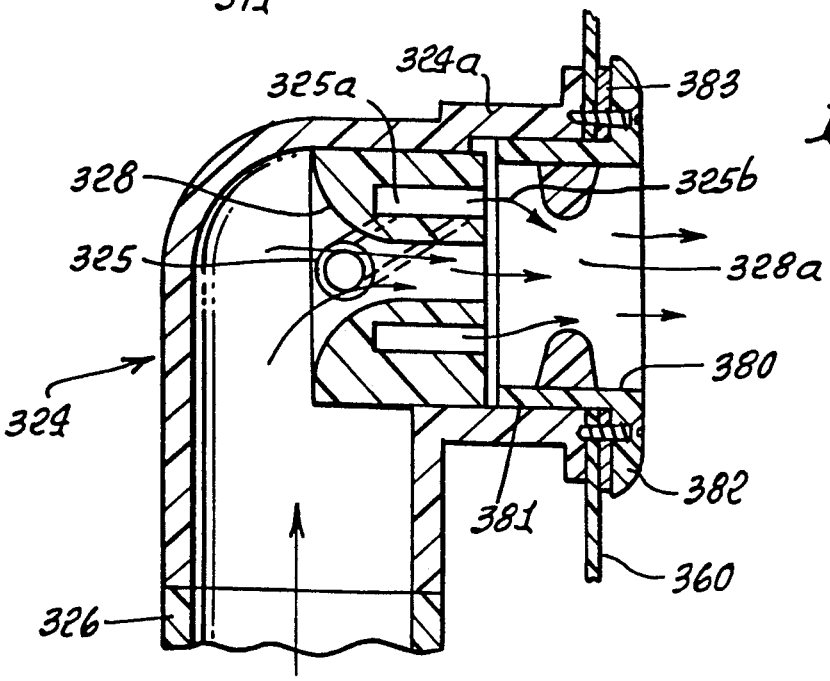
Figure 23:
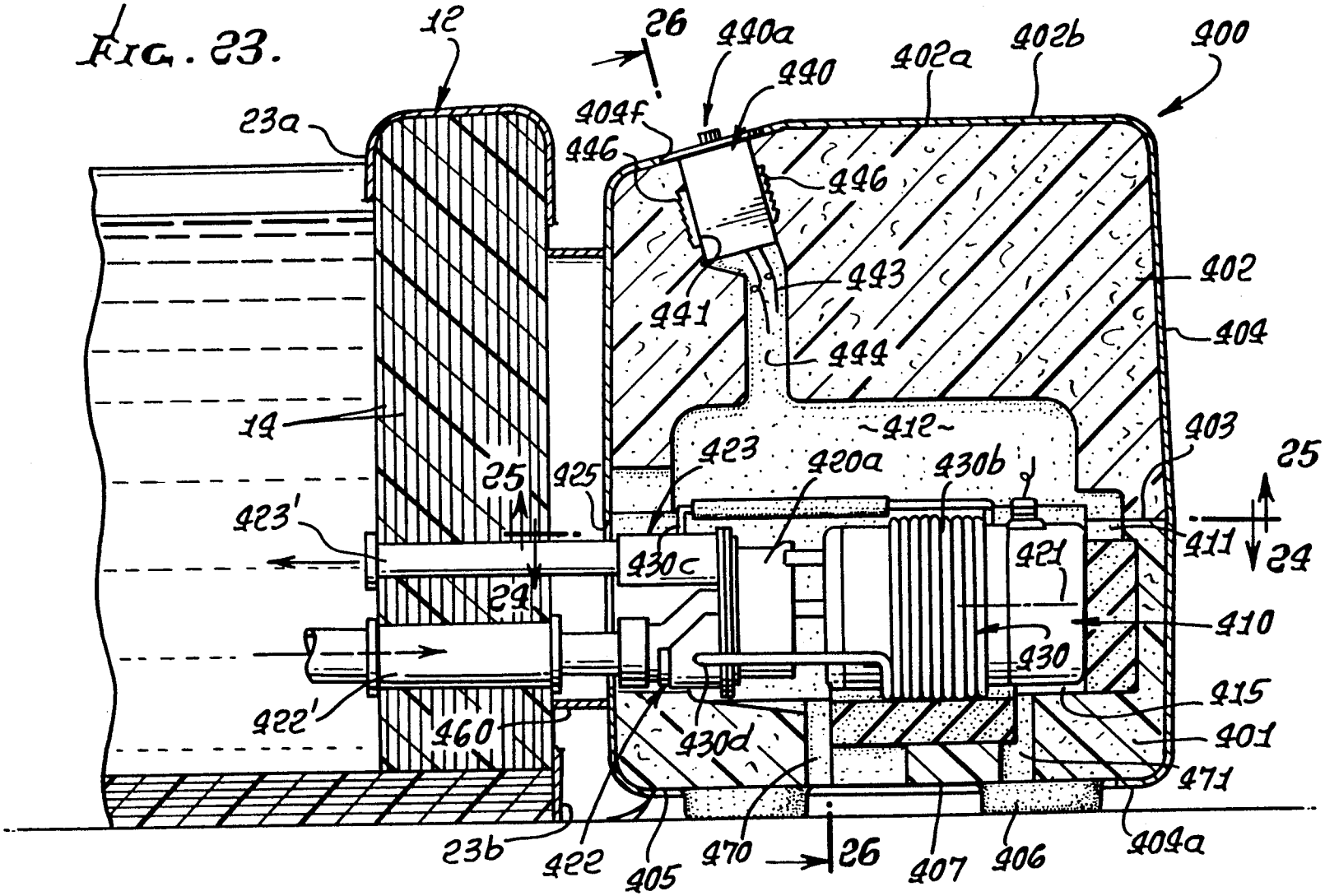
Figure 24:
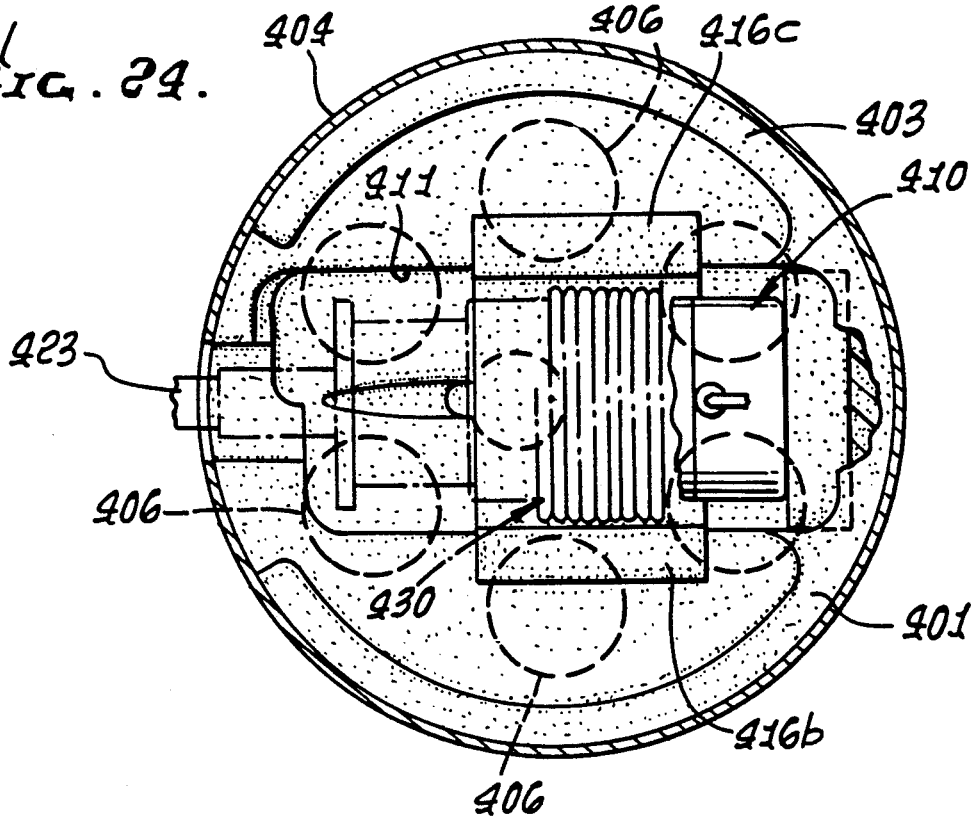
Figure 25:
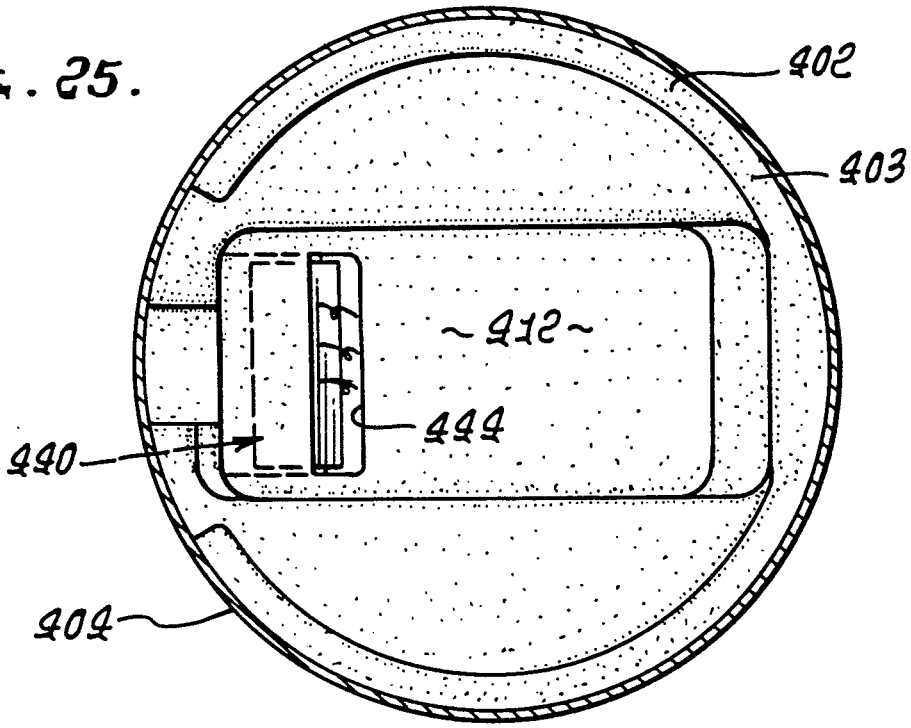
Figure 28:
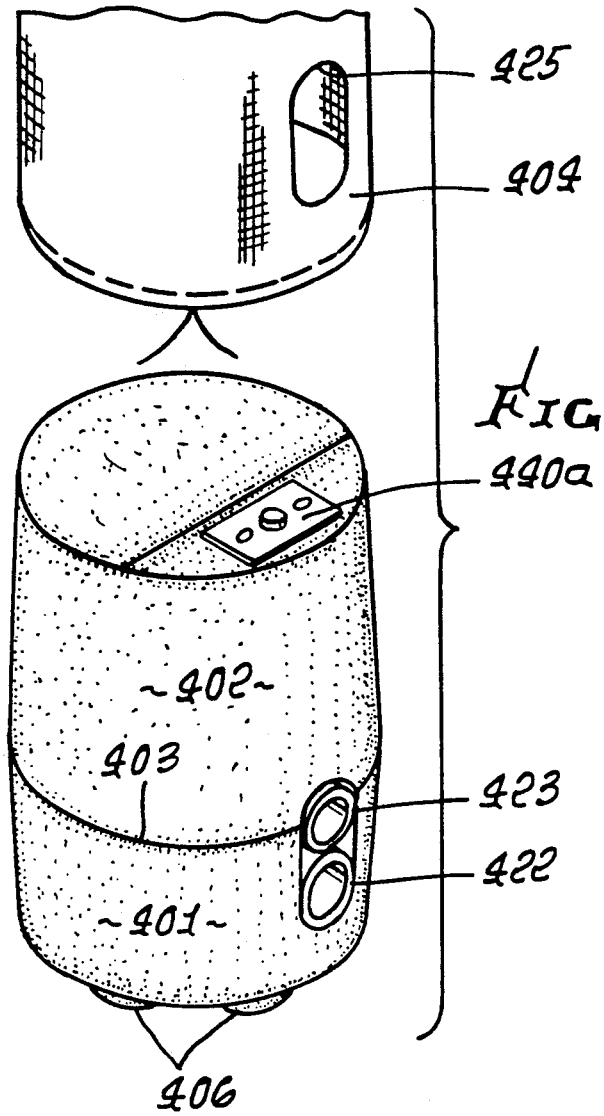
Figure 29:
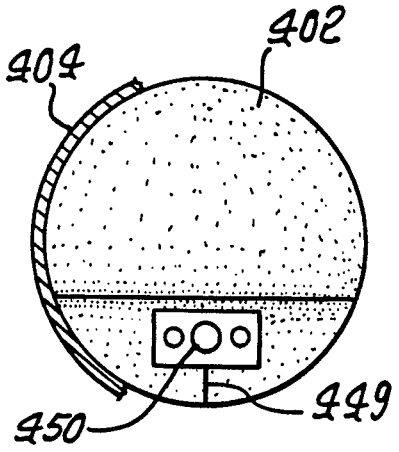
Figure 30:
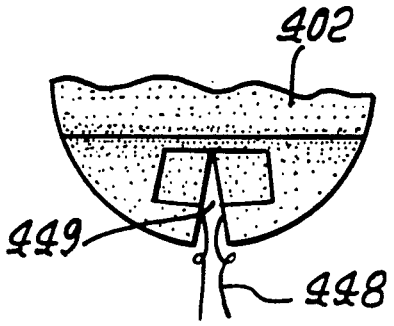
Figure 31:
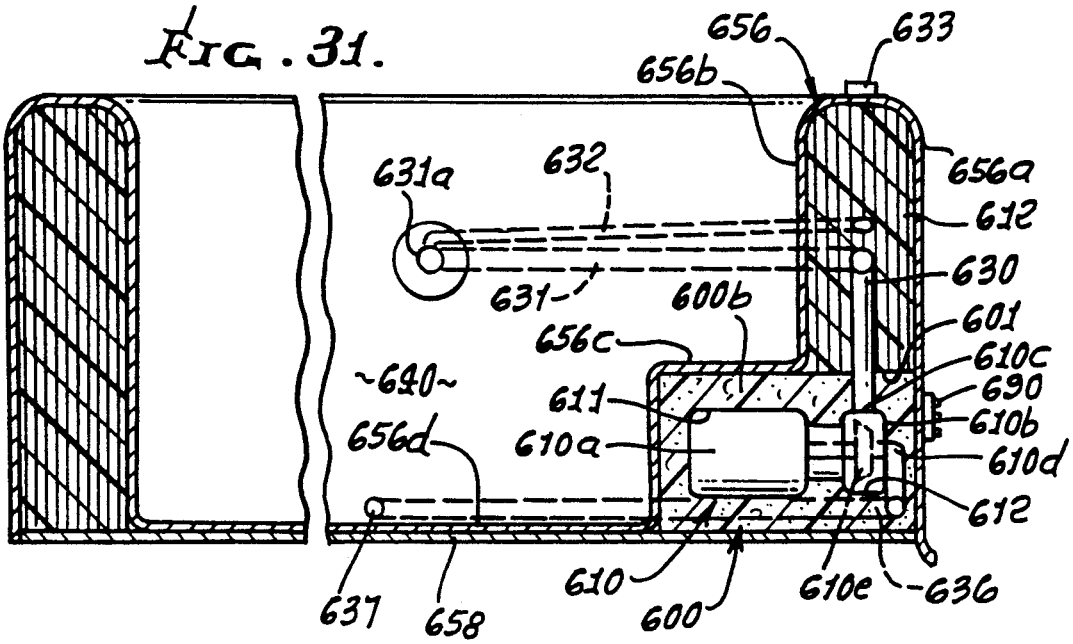
Figure 32:
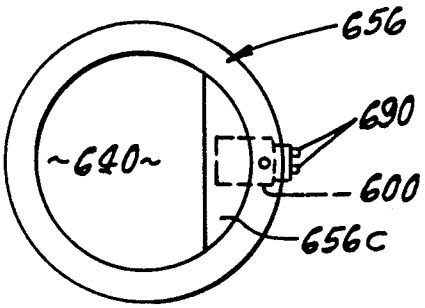
Figure 33:
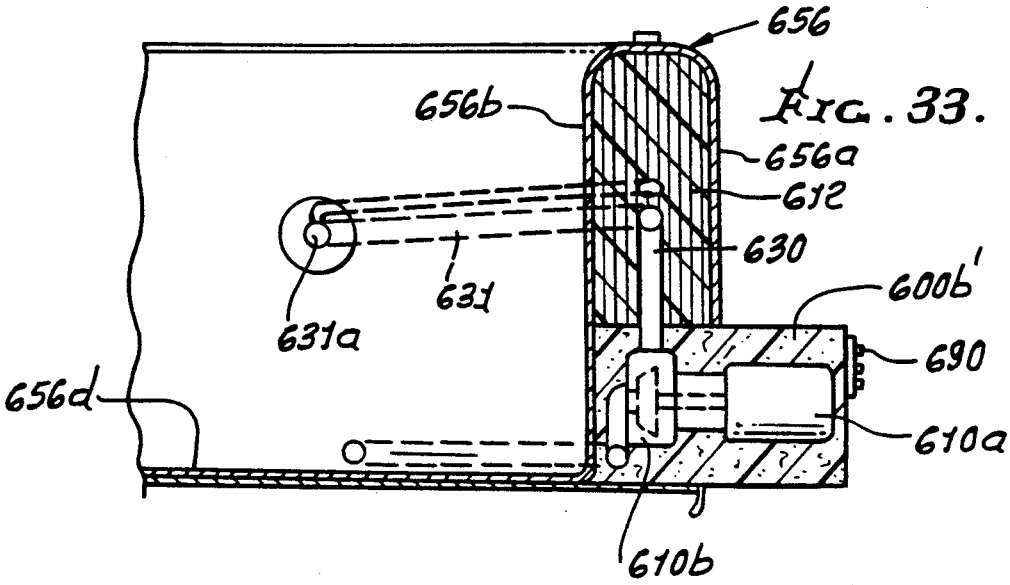

FIGS. 6 and 6*a* are enlarged views showing tub wall structure;

FIGS. 7*a* and 7*b* show plastic strips;

FIG. 8 shows a mesh formed by interwoven strips and coated with plastic;

FIG. 9 shows a completed liner;

FIG. 10 shows bonding of a liner to the tub wall;

FIG. 11 shows a completed tub with lining or linings applied;

FIG. 11*a* is a fragmentary view showing a jacket applied;

FIG. 12 is a plan view of a spa tub showing port location;

FIG. 12*a* is a fragmentary view of the port location shown in FIG. 12;

FIG. 13 is a perspective view of a portion of a tub, showing slit forming between port location;

FIG. 14 is a vertical section showing coring of the FIG. 13 tub portion, via the formed slit;

FIG. 14*a* is a view of the coring tool;

FIG. 15 is a vertical section showing the location of a vertical air passage formed in the tub wall to intersect a cored passage, and forming of the convex to rim of the wall;

FIG. 16 is a perspective view of a tubular elbow, with attached vertical pipe, and horizontal ducting, to be inserted into the cored passage, via the formed slit;

FIG. 16*a* is a horizontal section showing the FIG. 16 elbow in installed (inserted) position in the tub wall;

FIG. 17 is a plan view of a T-shaped, tubular fitting installed in the wall for spa drain purposes;

FIG. 18 is a vertical section through a tub wall showing cushioning for top closure sealing;

FIG. 19 is a vertical section showing an alternative connection of a pump to the spa ports;

FIG. 19*a* is an enlarged section;

FIGS. 20–22 are sections through the wall fittings;

FIG. 23 is an elevation taken in section through a plastic pack housing the pump unit, showing pack construction;

FIG. 24 is a horizontal section taken on lines 24—24 of FIG. 23;

FIG. 25 is a horizontal section taken on lines 25—25 of FIG., 23;

FIG. 26 is a vertical section taken on lines 26—26 of FIG. 23;

FIG. 27 is a perspective view of a retainer to retain a control unit in a recess in the pack upper plastic body;

FIG. 28 is a perspective view of the plastic pack with a jacket positioned to be assembled to the pack plastic base and cover;

FIG. 29 is a plan view of the control unit installed in the plastic cover;

FIG. 30 is a plan view of an alternate recess in the cover to receive the control unit;

FIG. 31 is a section like FIG. 23 showing a modification;

FIG. 32 is a plan view of the FIG. 31 tub;

FIG. 33 is another section like FIG. 23 showing another modification; and

Figure 34:
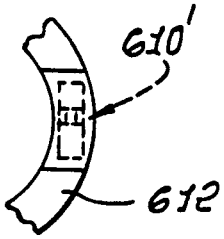

FIG. 34 is a schematic plan view showing a further modification.

DETAILED DESCRIPTION

Figure 1:
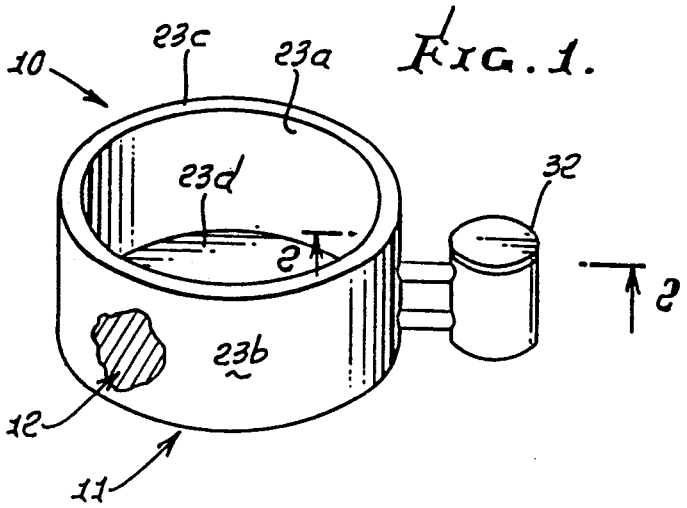
FIG. 1 is a perspective view of spa equipment embodying the invention.
Figure 2:
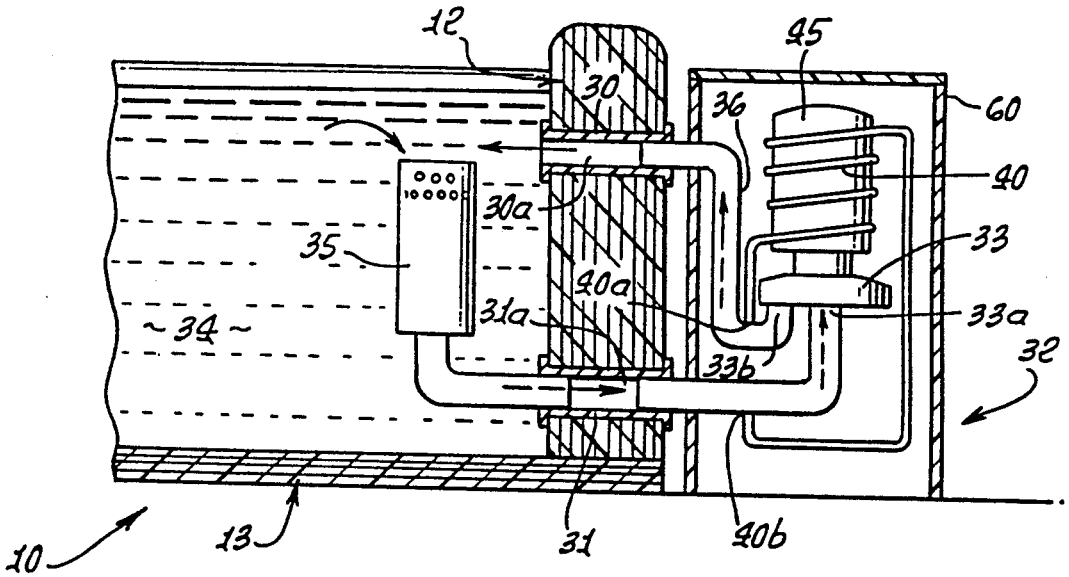
FIG. 2 is an enlarged section on lines 2—2 of FIG. 1.
Figure 3:
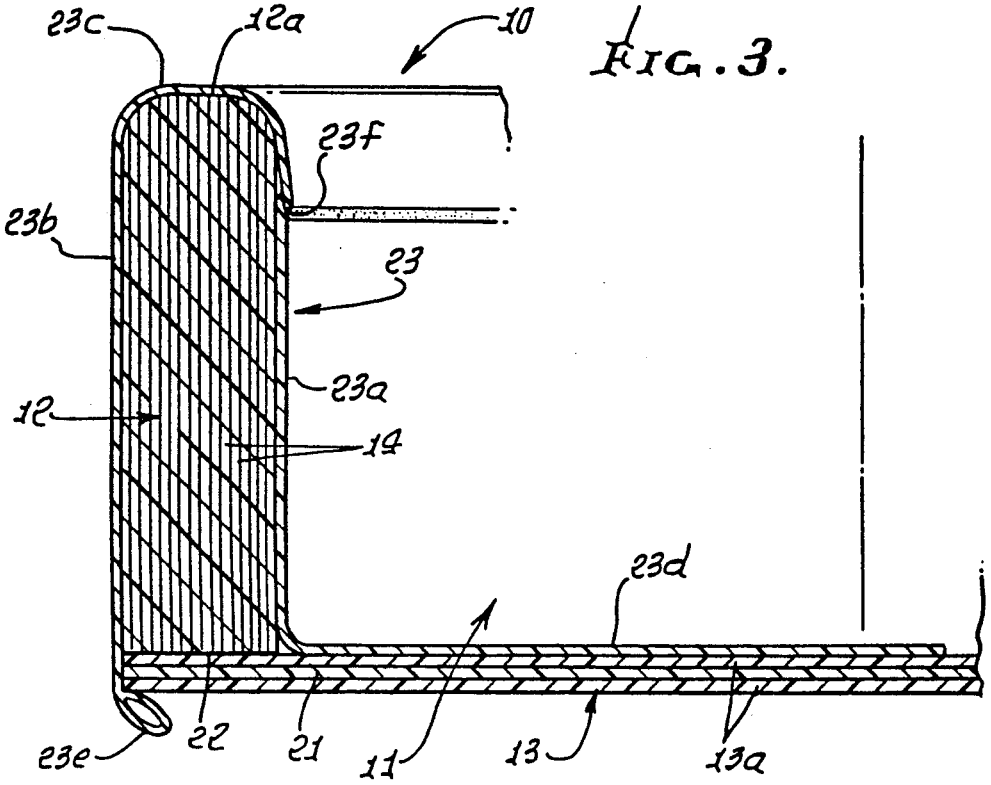
FIG. 3 is an enlarged section showing construction of the spa side wall and bottom wall.

In FIGS. 1-3, the apparatus 10 includes a tub 11 having an insulative, annular side wall 12, and a bottom wall 13 attached to side wall. The side wall comprises a foamed plastic sheet or sheets 14 wound in a spiral about the tub axis 15, to form multiple layers. The latter are better indicated at 16 in FIG. 6, with glass fiber reinforcement screen material 17 optimally fitted between the foamed plastic layers 16. Such layers may typically consist of polyethylene foam.

The polyethylene layers are rapidly joined together as by engagement of the outermost layer, during spiral winding, with a heating flame 18 and a roller 19, as seen in FIG. 6a. The pressure roller presses the heated inner surface of the outermost layer 17′ against the flame-heated, outer surface of the next inner layer 17″ to establish fusion contact, as for example through the spaces between warp strands 20, and also between woof strands extending at 90° to strands 20. Thus, an integral, relatively stiff and very sturdy, spiral fusion, laminated, lightweight side wall 12 is gradually formed during the spiral winding process; and a person may sit comfortably on the top edge or rim 12a of the wall 12 without damaging it or the tub construction.

The tub bottom wall 13 has a similar construction except that parallel sheets 13a (⅛ inch thick) of cross-linked polyethylene foam, with or without glass fiber layers 12 therebetween, are heated fusion welded to form an integral bottom wall. The latter is then peripherally fusion welded, as at 22 to the bottom of the side wall. A plastic jacket 23 may be fitted about both the side wall and bottom wall. Jacket 23 sheets may consist of foamed, reinforced, vinyl resin; and include inner sheet 23a, outer sheet 23b, crest sheet 23c, and bottom sheet 23d, all joined together to form an internal waterproof, decorative jacket, as shown. Outer sheets 23b and 23c may consist of marine grade vinyl, and inner sheets 23a and 23d of pool liner vinyl. Jacket lower edge extent may be looped, as at 23e, and a drawstring fitted in the loop to be drawn tight and attach the jacket to the wall 12. A welded or sewn seam is indicated at 23f. The vinyl jacket may be selected weatherable color.

Figure 4:
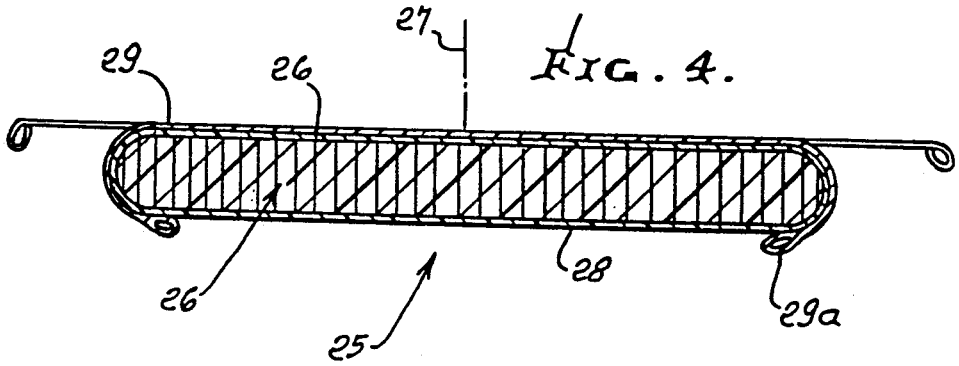
FIG. 4 is an enlarged section showing interior construction of the spa unit cover.

A tub cover is shown at 25 in FIG. 4, with generally the same spiral polyethylene layer construction, as does wall 12. Thus, spiral polyethylene layer or layers 26, extending about vertical axis 27, can be fusion welded together, similar to the wall section, but typically without the fibers. Additional structural stiffness may be imparted to the cover by creating thermally densified layers on each face 26 and 28, or by welding on denser foam layers. Thermally densified layers are created by compressing the spiral wound structure using at least one hot platten. A vinyl jacket 29 is fitted about the polyethylene windings and is held in place by a drawstring in loop 29a.

FIG. 2 shows upper and lower ports formed through the tub wall, as by tubular plastic fittings 30 and 31. Water circulating means 32 is connected with those ports, and includes a pump 33 for circulating water into the tub interior 34 via upper port 30a, and for withdrawing water from the tub interior 34, as via lower port 31a. A filter 35 is located within the tub to filter the water being withdrawn through port 31a, so that dirt and small objects are not fed to the pump lower inlet 33a. The filter is easily withdrawn, for example upwardly at the tub interior, for cleaning or replacement. The pump discharges sidewardly at outlet 33b, and plastic piping extends upwardly at 36 to deliver pressurized and heated water to port 30a, and an associated venturi. Multiple inlet ports and tee connections may be used.

The water circulating means includes an electric motor connected in driving relation with the pump, and includes a shunt duct connected with the water circulating means and located to receive heat generated by operation of the motor to heat a side stream of the water passing through the shunt duct. The illustrated shunt duct includes metallic tube 40 wound about the pump drive motor 45 to receive heat from same, for heating the tub water, whereby extreme simplicity and energy savings are realized. The duct 40 has an end connected at 40a into the water circulating system proximate pump outlet, i.e., into piping upper branch 36; its opposite end connected, as at 40b, into the water circulation system proximate pump inlet 33a, i.e., in lower piping branch 43 extending from port 31a to inlet 33a.

Accordingly, water flows in the shunt duct from a higher (pressurized) level to a lower level; and a portion of the water flowing through the pump is heated and reheated, for highly efficient heating action. Thus, no external source of heat for the hot tub water is required; and motor 45 serves multiple functions, its waste heat being efficiently utilized. The height of the inlet and outlet of the shunt duct are approximately the same to minimize thermosyphon action when the motor is off. The thermosyphon action can cause a momentary surge of extra hot water to trip the high limit switch 49. Or, the sensor can be located so it is not a problem and thermosyphon encouraged to get the most heat into the water, not lost from pack.

Figure 5:
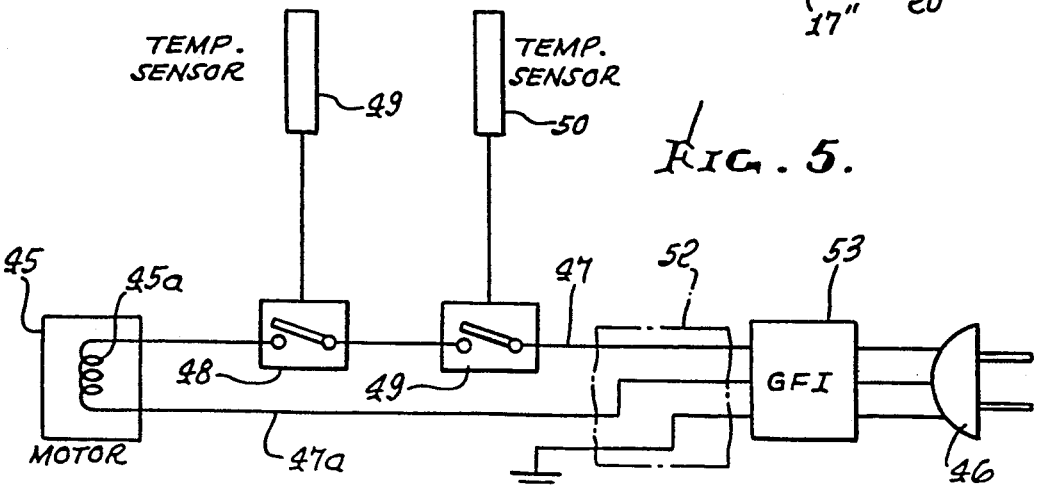
FIG. 5 is a wiring diagram.

In the schematic of FIG. 5, the motor coil 45a is supplied with electrical energy from a plug 46, such as is insertible into a household 120 volt outlet receptacle. The wiring interconnecting the plug and coil includes line 47 with which thermostat switch 48, and high limit switch 49, are connected in series. Switch 48 is operated by a thermostat sensor 49 applied to inlet port 30a, whereby, if the water is too hot, the motor is shut down. Limit switch 49 is also controlled by temperature sensor 50 located adjacent the tub to shut the motor down if the tub becomes overheated. Line 47 and return line 47*a* pass through cord 52, and through a ground fault interruptor 53, as shown.

A plastic shell enclosure or housing for the pump and motor is indicated at 60. It is well insulated to keep the heat generated by the motor inside where it can be transmitted to the water, and to minimize sound from the motor and pump inside for the comfort of the users. It is a compact package which facilitates ease of transport and set-up of same.

In FIG. 11, the tub apparatus 111 includes an insulative bottom wall 113 supporting the side wall, as by attachment to the lowermost extent thereof, at 113*a*. The side wall comprises a foamed plastic sheet or sheets 114 wound in a spiral about tub axis 115, to form multiple layers. Such layers may typically consist of polyethylene foam of between ⅛ and ⅜ inch thickness, as for example about ¼ inch thickness. The layers are rapidly joined together, as by engagement of the outermost layer, during spiral winding, with a heating flame, as described above in connection with FIG. 6*a*; however, no glass fiber screen is employed.

Instead, an inner liner 117 is provided adjacent the wall inner side 112*a*. As indicated in FIG. 9, that liner comprises interwoven strips 118*a* and 119*a* of pre-stretchable plastic material characterized in that the liner resists outward expansion toward wall 112 in response to loading exerted by liquid, such as water 121 in the tub interior. See FIG. 11. Therefore, The tub wall 112 is not deflected or stretched radially outward, as it would be in the absence of the liner.

FIG. 7*a* shows a typical thermoplastic (such as polyethylene) strip 118 or 119 prior to pre-stretching, endwise, in the direction of arrows 123 and 124.

FIG. 7*b* shows the same strip 118*a* or 119*a* after such stretching, with a correspondingly reduced width, to provide high tensile strength.

FIG. 8 shows the strips 118*a* and 119*a* closely interwoven with warp 118*a* and woof 119*a* strand or strip layer or mesh pattern 125. The woven strips are then embedded in or coated with a plastic coating 125*a* to prevent leakage of liquid therethrough and to provide load spreading. The plastic coating may also consist of polyethylene. Such a mesh is a product of Chave and Early, New York, N.Y., and sold under the name "CE-TEX".

FIG. 9 shows the completed liner 117, which includes a plastic foam layer 126 bonded in face-to-face relation with one side of the coating layer 125*a*. The layer 126 may, for example, consist of polyethylene foam. The bond interface is indicated at 128, and may be formed by heat fusion.

As a result, the composite liner 117 may be fusion bonded to the inner side 112*a* of the spiral layer wall 112. FIG. 10 shows that process. Bonding is carried out by heating the outer side 126*a* of the layer and/or the side 112*a*, to tacky state, and then pressing the hot, tacky side 126*a* against the side 112*a* of spiral layer wall 112. Liner 117 extends more than 360° around the tub, to provide overlap. Heating is effected by directing flame 130 or other heat source heat against sides 126*a* and/or side 112*a*, as seen in FIG. 10, and as the liner is progressively fed in direction 131, a pressure roller 132 rolling against the applied liner to press side 126*a* against side 112*a*.

FIG. 11 also shows a like liner 117′ applied against the outer side 112*a*′ of the wall 112, to also resist outward stretching of the wall 112 and also to add toughness. Finally, a jacket 133, like jacket 23, may be applied or attached to the inner surface 135 of the completed tub wall and to tub bottom wall 113, or to the liner 117. See FIG. 11*a*, the jacket applied in the same manner as in FIG. 3. A tub wall upper rim appears at 137 in FIG. 11. Jacket 133 may have the same construction as tensile liner 117.

In the above FIGS. 10, 11 and 11*a*, the lined tub wall, indicated by layers 114, may instead be a single layer of foam.

From the foregoing, it will be understood that the primary purpose of the tensile band or liner 117 is to absorb the hoop stress caused by the pressure resulting from the column of water in the tub. Without such tensile band, the water pressure places continuous compression and tensile stresses on the inner side of the tub wall. The polyethylene foam walls or layers 114 expand, especially at the bottom, in the absence of tensile band 117. That band also provides improved wall toughness and reduced communication of fluids between tub walls and outside environment.

A like tensile band in the wall between the inner and outer sides of the wall may be employed to absorb hoop stress, while allowing some compression and compliance of foam inside tensile band. One such layer, as seen in FIG. 11, may be considered to represent such an intermediate band.

An O.D. tensile band, as at 117′, is usable to absorb loads from people sitting on the tub wall, improve O.D. toughness, improve aesthetics, and reduce communication of fluids between tub walls and environment.

Jacket materials or composites may be constructed to have enough tensile strength to act as tensile band. Typically, materials include vinyl film or films laminated to polyester fabrics, and polyester fabrics coated with vinyl. Unattached and/or attached tensile band materials include metal foil, glass fiber reinforced polymers, aluminum sheet, coated and uncoated polyester fabrics, films laminated to polyester fabrics, spun bonded polyester fibers, tensilized polyester films, and tensilized polyethylene films slit to thin strips and woven in two axes and coated with polyethylene, as described herein. Thin layers of PE/EVA, PE, EVA, XLPE, and/or PVC foam may be attached to the inside of the tensile band to reduce water transport, improve aesthetics and/or feel, from inside the tub, to act as a tie layer, and to act as a compression element for plumbing seals.

Fiber or filament molecular orientation is preferably generally circumferential; however, bi-axial and random orientation are also possible.

Tensile band or bands may be attached to a liner for a tub wall inner surface or a jacket, as via adhesive, solvents, and/or thermal fusion techniques, including radio frequency heat sealing and ultrasonic welding. Tie layers may be used to make material attachment easier, via improved bonding capability, to add stiffness, to reduce leakage, and/or improve aesthetics and feel.

Intermediate tensile bands (between I.D. and O.D.) may use the above-described materials, or glass fibers and polymer fibers in loose, uni-directional and bi-directional fabrics, fused between layers of polyethylene foam during wall construction. Outer side tensile bands may be fastened using above methods, or by shrinking on the tub outer wall.

Tensile band material candidates are typically available as rolls and must be overlapped to create a circumferential tensile band. Although tensile bands spirally wound into the tub wall may be overlapped without direction connection, I.D. and O.D. tensile bands typically require joining as via solvents, adhesives, mechanical fasteners and/or thermal fusion techniques.

Referring now to the modified tub of FIG. 12, it shows the locations of ports in the tub wall 299, as during construction of the tub, following forming of the spiral layer wall, as described above. Inlet and outlet ports are shown at 300 and 301, with T-shaped tubular fittings 302 and 303 in those ports. The ports extend only part way into the tub wall, from the outer side thereof, and are formed, as by use of electrically heated circular wire or knife 305 applied to the wall, in a radial direction. The drain port 301 is below and lower than the inlet port 300, as shown in FIG. 12a.

Also shown are the location of two jet inlet ports 306 and 307 formed radially outwardly from the inner side 299a of the tub wall, and at 180° spacing about the tub axis 308. Two (or more) outlet ports 309 and 310 are also formed radially outwardly from the inner side 299a of the tub wall, and at about 90° spacings about axis 308. Other angularities are usable.

Next, slits are cut into the tub wall, including slits 311 and 312, respectively, between inlet 300 and the jet ports 306 and 307; and slits 313 and 314, respectively, between the drain port 301 and the outlet ports 309 and 310. Slits 311 and 312 may be cut into and from the inner side of wall 299, at the level of port 300; and slits 313 and 314 may be cut into and from the outer side (or inner side) of the wall, at the level of port 301. The slits are cut to depths allowing insertion of a coring tool 315 (see FIG. 14a) into port 300, for example, and then travel of the tool circumferentially into alignment with first port 306 and the port 302. The tool 315 has an electrically heated, looping, metal band 315, that cores the passages 311a and 312a associated with slits 311 and 312, with electrical leads 317 and 318 that mount band 316 and pass radially through and along the slit (311 or 312) as the tool is moved circumferentially. Heating of the band is to temperatures that melt the thermoplastic of the wall, in situ, as the band is advanced, after the wall is formed. The severed, shaped, core pieces are then pulled out through the slits. In similar manner, passages 313a and 314a, associated with slits 313 and 314, are formed by tool 315. Note that the formed passages extend through adjacent layers of the wound plastic wall.

Next, aeration passages 320 are formed vertically above the injection ports 306 and 307, as seen in FIG. 15. Aeration passages 320 may extend in directions other than vertical. Also, the top rim of the wall is shaped to be convex upwardly. FIG. 15 shows an electrically heated, curved cutter band 321 being advanced lengthwise (normal to the plane of FIG. 15) around the tub rim to sever material above the band. Note electrical leads 322 and 323.

Next, water injection elbow tube duct assemblies, as seen in FIG. 16, are inserted (by pushing them) into ports 306 and 307, so that the plastic elbows 324 are received in the ports, air inlet plastic tubes 325 are received in the passages 320, and flexible plastic ducts 326 are received in the cored passages 311a and 312a (by pushing them radially through the slits 311 and 312) and extending toward port 300.

FIG. 16a shows the injection elbow interior construction, with a venturi 328 receiving water from duct 326 and jetting aerated water from the elbow into the tub interior. The venturi receives air from the aeration tube 325 and air flow regulatory means appears at 325d. See jet 328a. Passage 320 and tube 325 extend in upper rim 299c of the tub wall. As seen in FIG. 22, a wall fitting 380 has fit at 381 with box end 324a of the elbow 324, and a flange 382 on the wall fitting clamps an annular seal 383 against the tub jacket 360 to establish a seal. Plenum 328a receives water from the venturi 328, mixed with air supplied by duct 325 to annulus 325a to exit at 325b and mix with the water flow.

FIG. 17 is a section showing a tee 329 having a stem 329a, as fitted into each of the entrance and drain ports 300 and 301. The tubular tee head 329b is in alignment with passages 311 and 312, and connected with ducts 311a and 312a therein; and a similar tee head 329b is in alignment with passages 313 and 314 and connected with ducts 313a and 314a therein. Tubular connection fittings 330 and 331 are connected with stem 329a, and are connectible with external ducting (see duct 331 in FIG. 19). Elbow 370, as seen in FIG. 21, may be inserted at ports 309 and 310. Water flows from the tub into inlets 371. It then turns at 373 and flows to a plastic tube 374 in core 313 or 314.

FIG. 19 shows the by-pass duct 333 that has metallic heat conductive windings 333c about the motor 336 to receive heat therefrom, has its intake at 333a at elbow 344, and its exit or discharge end at 333b, the throat of venturi 334 in duct 331. Therefore, heat from the motor is transferred to the water passing directly to the tub interior via jets at 306 and 307, and the pressure differential between 333a and 333b facilitates flow in the by-pass duct 333. Water draining from the pool or tub at port 301 passes via duct 332 to the intake 340 of centrifugal pump 341 driven by the motor. The pump discharge, at 342, passes via metallic riser duct 343, plastic elbow 344, venturi 334, and plastic duct 331 to tub intake port 330. Temperature control sensors 350 are applied to the metallic riser duct 343 to sense the temperature of the water flowing to the spa, and those sensors are covered by a plastic foam sheath 354. A filter 361 in the spa tub removes particulates from the water recirculated to the tub interior via duct 331. The filter may be at the inlet 301.

FIG. 19a shows the use of heat conductive thermal mastic at 450 between the motor and the windings to conduct heat efficiently from the motor to the coil. An example is the product T-70, produced by Thermal Industries, Texas.

In FIG. 18, a vinyl jacket 360 fits over the tub wall 299, and over the tensile liner 361 adherent to the inner side of the wall, to seal off the slits 311, 312, 313, and 314 referred to. An annular resilient cushion 362 inside the jacket, near the top of the wall, provides an interference fit with a tub cover 365, a shown, sealing off the tub interior. The cushion may consist of open cell urethane foam. The jet elbow and drain fittings have sealing engagement with the jacket, as via clamping flanges 366, seen in FIG. 17. The jacket 360 forms openings in alignment with the ports, as at 306, 307, 309, and 310.

The fittings seen in FIG. 20 may be employed at the connection between duct 330 and duct 331. These ducts have ends 330a and 331a urged together as annular coupling 390 bridging such ends is rotatably tightened. Coupling 390 has internal threads 391 engaging external threads 392 on duct 331; and it has an internal shoulder at 393 engaging external shoulder 394 on duct 330.

FIG. 23 again shows a foamed, resiliently compressible, plastic tub side wall 12, which is typically annular and formed by winding a foamed plastic sheet 14 about a mandrel, to provide side wall layers in a spiral configuration, as referred to above. A plastic jacket is fitted over both the tub side wall 12 and bottom wall, as at 23*a* and 23*b*, and as referred to above.

A plastic pack 400 is provided externally of the tub apparatus 10, and may advantageously include a foamed plastic base 401 and a foamed plastic cover 402 received on the base, as in interfitting relation at ledge 403. These elements 401 and 402 may consist of yieldably and resiliently compressible material, such as expanded bead polypropylene. A vinyl, plastic jacket 404 is fitted over the base and cover, and may fit under the base at 404*a* in the form of a sack bottom, centrally open at 405. A multiplicity of plastic feet or supports 406 are integral with the bottom 407 of the base, and extend downwardly through the opening 405 to support the pack. The jacket 404 is shown as extending over the top surface 402*a* of the cover at 404*b*.

The cover and base may consist of resiliently yieldable plastic material, to sturdily and protectively support and confine a motor/pump unit 410, as within cavities 411 and 412 in the molded base and cover.

The base contains a sub-cavity 415, below cavity 411, and which is U-shaped, as seen in FIG. 26. A U-shaped pad 416 interfits the cavity 415, and has a lower portion 416*a*, and two upwardly extending side portions 416*b* and 416*c*. The space 417 formed by the inner walls 416*a*', 416*b*', and 416*c*' of the pad receives the generally cylindrical motor/pump unit 410, corresponding to that described at 45 in FIG. 2; however, the axis 421 of motor rotor and pump rotor rotation is horizontal. This in turn enables shortening of the water input and output ducts 422 and 423, since the pump 420*a* is presented close to the side of the pack adjacent to the tub wall 412. Opening 425 in jacket 404 passes the ducts 422 and 423, as shown. Glass fiber pad 16 serves to deaden sound produced by the motor, and to insulate the coils from surrounding plastic to prevent injury to the latter. The upwardly presented plastic surface 415 of the cavity may be densified for strengthening, by heat (250°-350° F.) and pressure application to the plastic material. The top of 402 and bottom of 401 may also be densified, in similar manner. It will be understood that ducts 422' and 423' in wall 12 may extend lengthwise in wall 12, about the tub interior, as for example in the manner as referred to in FIG. 2, with jets provided as described.

A metallic shunt duct 430 is wrapped in coils 430*b*, about the metal housing of the motor, to receive motor heat for heating the water in the shunt duct. Input and output ends 430*c* and 430*d* of duct 430 are connected to pump output duct 423, and pump input duct 422, as shown, to use the pump pressure differential to flow a side stream of water through the coils and deliver heated water back to 422 (upstream) for mixing with the main flow recirculation through the pump then on to delivery to tub at 432. Pad 416 is insulative, so that heat loss from the motor and coils is minimized, and heat transfer from the motor metal housing to the metal coils 430*b* is optimized. The insulative characteristics of the plastic base 401 and cover 402 enhances heat retention in cavities 411 and 412, and efficient heat transfer to water being delivered to the tub interior.

Also provided is control means received in the cover and connected with the pump unit, the control means accessible from the exterior of the cover for controlling the operation of the pump unit. As shown, the control means or unit 440, including a control box, is received downwardly in a recess 441 sunk in the cover 402, so that the control panel 440*a* of the unit 440 is exposed upwardly for ease of operation. Jacket 404 contains an opening at 404*f* in registration with panel 440*a*. Wires 443 extend downwardly from the control unit and to the motor, via a cavity 444 and cavity 412, as shown in cover 402.

Serrated retainers 446 at one or opposite sides of the unit 440 serve to penetrate the walls of recess 441 to retain the unit 440 in position. See also FIG. 27. Electrical wires 448 from the exterior may pass to unit 440 via a split 449 in the side of the cover 402. See FIG. 30. Control knobs appear at 450. Jacket 404 exerts hoop tension forces acting on 402 to close the split in FIG. 29.

The tub wall associated tensile band resists tub wall expansion toward the pack 400, to enhance overall integrity of the plastic tub and motor unit pack articles.

FIG. 23 also shows a protective shell 460 extending in the space between wall 12 and pack 400, consisting of insulative material and about the tubular ducts 422 and 423 and to insulate the hot water in ducts 422 and 423 and reduce noise from motor and pump 410.

Drainage openings appear at 470 and 471.

In another aspect of the invention, the plastic pack containing the pump unit is integrated with the tub wall, i.e., is in that wall or partly in that wall. For example, in FIG. 31, the plastic pack 600 is provided to extend within an opening or cut-out 601 in the wall 612 (corresponding to wall 12 above). The pack contains a cavity 611 that receives motor 610*a* of pump unit 610, and a cavity 612 that receives the pump housing 610*b* of unit 610. The pump housing is in vertical alignment with wall 612, in that the pump housing outlet 610*c* is directly connected at 630 with ducting 631 in wall 612, that ducting extending about the tub interior to a water jet 631*a* of the type described above. An air duct 632 also extends to the jet and air is aspirated into the jet of water that emanates from 631. An air valve 633 is controllable at tub wall 612 to vary the amount of air so aspirated. Pump impeller 610*e* is in 610*b*.

Note that the pump housing has its intake port 610*d* in the side wall defined by that part of the pack 600 in alignment with wall 612, and is in direct communication with the return flow water duct 636 in wall 612, and extending from a drain 637.

The pack portion 600*b* that surrounds the unit 610 projects laterally into the tub interior 640, and forms a seat for the tub user. Heat from the motor that may pass through the plastic pack heats the water in the tub interior. This form of the invention eliminates need for external ducting and connections to tub ducting. A protective liner 656 of suitable plastic material extends at opposite sides of the wall 612, as at 656*a* and 656*b*, and also over the pack 600 at 656*c* and over the tub bottom wall 658 at 656*d*. It may consist of a tensile liner at 656*b*, to resist outward deformation forces. The liner at 656*c* cooperates with the pack at 600*b* to form the seat. See also FIG. 32, and pump unit controls at 690.

In FIG. 33, all elements are the same, except that the pack portion 600*b*' projects exteriorly of the wall 612, to form a step.

In FIG. 34, the entire pump unit 610' is in vertical alignment with the wall 612.

We claim:

1. Tub apparatus, comprising a) a plastic tub wall having an inner side and an outer side, the tub having an interior to receive liquid, and ports extending through said side wall, b) a plastic pack having a cavity formed therein, c) a pump unit received in said cavity and protectively enclosed by said plastic pack, d) and tubular duct means connected with said pump unit and extending from said cavity to said ports for circulating liquid between the tub interior and said pump unit, e) said pack including a base and a cover on the base, at least one of the base and cover consisting of plastic material, and there being means enclosing said base and cover for retaining said base and cover in integrated relation, while allowing said duct means to extend relative thereto between the cavity and said ports, as aforesaid.

2. The apparatus of claim 1 wherein said pack is at the exterior of said tub side wall, said ports located at upper and lower elevations in said side wall.

3. The apparatus of claim 1 wherein both the base and cover consist of lightweight plastic material, the cavity located in the base.

4. The apparatus of claim 3 wherein said base and cover consist of foamed plastic material.

5. The apparatus of claim 3 including a generally U-shaped insulative and protective pad means supported in said base, the pump unit seated on said pad.

6. The apparatus of claim 5 wherein the pump unit includes a pump and a motor, the motor having a housing, there being a shunt duct for said liquid wound about the motor housing said shunt duct supported on said U-shaped pad, and input and output ends of the shunt duct connected to the tubular duct means extending to the port in the tub wall through which hot water is delivered to the tub interior.

7. The apparatus of claim 3 including a control means received in said cover and connected with said pump unit, said control means accessible from the exterior of the cover for controlling the operation of the pump unit.

8. The apparatus of claim 7 including a split in the wall of the cover to pass external electrical wiring to the control means.

9. The apparatus of claim 7 including serrated retainer means carried by the plastic pack and located at at least one side of the control means to hold said means in said cover.

10. The apparatus of claim 9 including a recess in the cover into which a box defined by said control means is received and gripped by the plastic cover.

11. The apparatus of claim 1 wherein said tubular means is received in said ports in said tub wall to pass said liquid, there being a jacket extending about said tub wall and through which said tubular duct means extend.

12. The apparatus of claim 1 including a tensile liner adjacent the tub wall, and characterized in that the liner resists outward expansion toward said pack in response to loading exerted by liquid filled into the tub interior.

13. The apparatus of claim 12 wherein said liner consists essentially of synthetic resin.

14. The apparatus of claim 1 wherein said tubular duct means includes a first tubular body in the form of a fitting received in one of said ports, there also being a gas passage in said tub foamed wall in communication with said fitting to pass gas to the liquid flowing to the tub interior.

15. The apparatus of claim 14 including a duct inserted into said passage and connected with said fitting, to pass said gas to the fitting, said duct extending to an upper rim defined by said wall.

16. The apparatus of claim 14 including a liquid duct connected with said fitting to circulate liquid in series communication therewith, the liquid duct embedded in said resiliently compressible tub wall, lengthwise thereof.

17. The apparatus of claim 16 wherein the wall defines a slit, lengthwise of the wall and adjacent said liquid duct, and via which that duct is inserted into the wall.

18. The apparatus of claim 1 including a protective shell associated with the tub apparatus and extending in space formed between the tub wall and said plastic pack, and about said tubular duct means in said space.

19. The apparatus of claim 1 wherein said cavity has a densified surface supporting the pump unit.

20. The apparatus of claim 19 wherein the plastic pack consists of foam plastic.

21. For combination with tub apparatus comprising a tub wall having an inner side and an outer side, the tub having an interior to receive liquid, and ports extending in said tub wall, the improvement comprising:

a) a plastic pack having a cavity formed therein, b) a pump unit received in said cavity and protectively enclosed by said plastic pack, c) and tubular duct means connected with said pump unit and extending from said cavity to said ports for circulating liquid between the pump unit and said tub interior, d) said pack including a base and a cover on the base, and there being a flexible jacket enclosing said base and cover for retaining the base and cover in integrated relation, said duct means extending through said jacket.

22. The apparatus of claim 21 wherein said base and cover consist of plastic material, the cavity located in the base.

23. The apparatus of claim 22 wherein said base and cover consist of foamed plastic material.

24. The apparatus of claim 22 including a U-shaped insulative pad supported in said base, the pump unit seated on said pad.

25. The apparatus of claim 24 wherein the pump unit includes a pump and a motor, the motor having a housing, there being a shunt duct for said liquid wound about the motor housing said shunt duct supported on said U-shaped pad, and input and output ends of the shunt duct connected to the tubular duct means extending to the port in the tub wall through which hot water is delivered to the tub interior.

26. The apparatus of claim 22 including a control means received in said cover and connected with said pump unit, said control means is accessible from the exterior of the cove for controlling the operation of the pump unit.

27. The apparatus of claim 26 including a split in the wall of the cover to pass external electrical wiring to the control means.

28. The apparatus of claim 21 wherein said tubular means is received in said ports in said tub wall to pass said liquid, there being a jacket extending about said tub wall and through which said tubular duct means extend.

29. Tub apparatus, comprising a) a foamed, resiliently compressible, plastic tub wall having an inner side and an outer side, the tub having an interior to receive liquid, and ports extending through said side wall, b) a plastic pack having a cavity formed therein, c) a pump unit received in said cavity and protectively enclosed by said plastic pack, d) and tubular duct means connected with said pump unit and extending from said cavity to said ports for circulating liquid between the tub interior and said pump unit, e) the tub wall plastic being foamed, and wherein the foamed plastic pack is integrated into and projecting from the foam plastic tub wall.

30. The combination of claim 29 wherein said pump unit includes a pump having a housing and an impeller, and a motor connected in driving relation with said motor, said pump housing located in vertical alignment with said tub wall.

31. The combination of claim 30 wherein said motor projects laterally of said pump housing, and said tub interior having an upper portion extending above said motor.

32. The combination of claim 31 including protective material extending at least part way about the motor.

33. The combination of claim 32 including a liner sheet lining said tub wall at the side thereof facing said tub interior, said liner sheet extending over said protective material and forming therewith a seat in said tub interior.

34. The combination of claim 31 wherein said motor projects laterally of the pump housing, and toward the exterior side of said tub wall.

35. The combination of claim 29 wherein said pump unit has a discharge port located in said tub side wall to directly deliver pressurized water to said tubular duct means.

36. The combination of claim 35 including an intake air duct in said wall to deliver air to said tubular duct means.

37. The combination of claim 35 wherein said pump unit has an intake port in said tub side wall to receive return water flow from the tub interior.

38. The combination of claim 37 including a return water flow duct in said side wall in direct communication with said pump unit intake port.

39. For combination with tub apparatus comprising a tub wall having an inner side and an outer side, the tub having an interior to receive liquid, and ports extending in said tub wall, the improvement comprising:

a) a plastic pack having a cavity formed therein, b) a pump unit received in said cavity and protectively enclosed by said plastic pack, c) and tubular duct means connected with said pump unit and extending from said cavity to said ports for circulating liquid between the pump unit and the tub interior, d) said pack including a plastic base and a foamed plastic cover received on said base, the pump received in the cavity in said base, e) a control means received in said cover and connected with said pump unit, said control means being accessible from the exterior of the cover for controlling the operation of the pump unit, f) there being a hole in said cover, and including serrated retainer means carried by the plastic pack at at least one side of the control means to hold said control means in said hole, the serrated retainer means having serrations gripped by the foamed plastic of the cover at the side of the hole.

40. The apparatus of claim 39 including a recess in the cover into which a box defined by said control means is received and gripped by the plastic cover.

41. The method of forming a tub apparatus, which includes:

a) forming a resiliently compressible, plastic tub wall having an inner side and an outer side, the tub having an interior to receive liquid, and ports extending through said side wall, b) forming a plastic pack having a cavity formed therein, c) providing a pump unit and placing said unit in said cavity to be protectively enclosed by said plastic pack, d) providing duct means connected with said pump unit and to extend from said cavity to said ports for circulating liquid between said pump unit and the tub interior, e) providing the pack with a base and a cover thereon, and providing a flexible protective means closely fitting about said base and cover for retaining said base and cover in integrated relation, and extending said duct means through said protective means.

42. The method of claim 41 which includes providing said base and cover to have foamed plastic construction the cavity located in said base, below said plastic cover.

43. The method of claim 42 which includes locating said plastic pack externally of said tub wall.

44. The method of claim 42 which includes integrating said plastic pack into said tub wall.

45. The method of claim 42 wherein said base and cover consist of foamed plastic material.

46. The method of claim 42 including providing and locating a U-shaped insulative pad supported in said base, the pump unit then seated on said pad.

47. The method of claim 42 including providing a control means in said cover and connected with said pump unit and in such manner that said control means is accessible from the exterior of the cover for controlling the operation of the pump unit.

48. The method of claim 47 including providing a split in the wall of the cover to pass external electrical wiring to the control means.

49. Tub apparatus, comprising a) a resiliently compressible, plastic tub wall having an inner side and an outer side, the tub having an interior to receive liquid, and ports extending through said side wall, b) a plastic pack having a cavity formed therein, c) a pump unit received in said cavity and protectively enclosed by said plastic pack, d) and tubular duct means connected with said pump unit and extending from said cavity to said ports for circulating liquid between said pump unit and the tub interior, e) said pack including a plastic base and a plastic cover received on the base, the cavity located in the base, f) and including a flexible jacket closely fitting about said base and cover for retaining the base and cover in integrated relation, said duct means extending through said jacket.

50. Tub apparatus, comprising a) a foamed, resiliently compressible, plastic tub wall having an inner side and an outer side, the tub having an interior to receive liquid, and ports extending through said side wall, b) a plastic pack having a cavity formed therein, c) a pump unit received in said cavity and protectively enclosed by said plastic pack, d) an tubular duct means connected with said pump unit and extending from said cavity to said ports for circulating liquid between said pump unit and the tub interior, e) said pack including a plastic base and a plastic cover received on the base, the cavity located in the base, f) a control means received in said cover and connected with said pump unit, said control means accessible from the exterior of the cover for controlling the operation of the pump unit, g) and including a flexible jacket closely fitting about said base and cover for retaining the base and cover in integrated relation, said duct means extending through said jacket, said jacket having an opening via which said control means is accessible from the exterior of the pack.

51. For combination with tub apparatus comprising a tub wall having an inner side and an outer side, the tub having an interior to receive liquid, and ports extending in said tub wall, the improvement comprising:

a) a plastic pack having a cavity formed therein, b) a pump unit received in said cavity and protectively enclosed by said plastic pack, c) and tubular duct means connected with said pump unit and extending from said cavity to said ports for circulating liquid between said pump unit and the tub interior, d) the base and cover consisting of plastic material, the cavity located in the base, e) and including a flexible jacket closely fitting about said base and cover for retaining the base and cover in integrated relation, said duct means extending through said jacket.

52. For combination with tub apparatus comprising a tub wall having an inner side and an outer side, the tub having an interior to receive liquid, and ports extending in said tub wall, the improvement comprising:

a) a plastic pack having a cavity formed therein, b) a pump unit received in said cavity and protectively enclosed by said plastic pack, c) and tubular duct means connected with said pump unit and extending from said cavity to said ports for circulating liquid between the tub interior and said pump unit, d) the base and cover both including plastic material, the cavity located in the base, e) control means received in said cover and connected with said pump unit, said control means being accessible from the exterior of the cover for controlling the operation of the pump unit, f) and including a flexible jacket closely fitting about said base and cover, whereby the cover and base are covered in integrated relation, said duct means extending through said jacket, said jacket having an opening via which said control means is accessible from the exterior of the pack.

53. Tub apparatus, comprising a) a resiliently compressible, plastic tub side wall having an inner side and an outer side, the tub having an interior to receive liquid, and ports extending in said side wall, b) a plastic pack having a cavity formed therein, c) a pump unit received in said cavity and protectively enclosed by said plastic pack, d) and tubular duct means connected with said pump unit and extending from said cavity to said ports for circulating liquid between the pump unit and the interior, e) and wherein said plastic pack consists of foamed plastic and has at least one thermally densified surface for supporting the pump unit.

54. The method of forming a tub apparatus, which includes:

a) forming a foamed, resiliently compressible, plastic tub wall having an inner side and an outer side, the tub having an interior to receive liquid, and ports extending through said side wall, b) forming a plastic pack having a cavity formed therein, c) providing a pump unit and placing said unit in said cavity to be protectively enclosed by said plastic pack, d) and providing duct means connected with said pump unit and to extend from said cavity to said ports for circulating liquid between the pump unit and the tub interior, e) providing said pack with a plastic base and a plastic cover received on the base, the cavity located in the base, below said cover, f) and including providing a flexible jacket closely fitting about said base and cover for retaining the base and cover in integrated relation, and extending said duct means through said jacket.

55. Tub apparatus, comprising a) a foamed, compressible, plastic tub side wall with an inner surface and an outer surface, the tub having an interior to receive liquid, and ports extending through said side wall, b) a foam plastic pack having a cavity formed therein, c) a pump unit received in said cavity and completely protectively enclosed by said plastic pack, d) and tubular duct means connected with said pump unit and extending from said cavity to said ports for circulating liquid between the tub interior and said pump unit, e) said pump unit including a pump and a motor, the motor having a housing, there being a duct for said liquid wound about the motor housing to receive heat transfer from the motor to thereby heat the liquid, f) and including a U-shaped insulative and protective, non-metallic pad means supported in said base, the pump unit seated on said pad, and the pad means extending upwardly at opposite sides of the motor housing.

56. Tub apparatus, comprising a) a foamed, compressible, plastic tub wall having an inner side and an outer side, the tub having an interior to receive liquid, and ports extending through said side wall, b) a plastic pack having a cavity formed therein, c) a pump unit received in said cavity and protectively enclosed by said plastic pack, d) and tubular duct means connected with said pump unit and extending from said cavity to said ports for circulating liquid between the tub interior and said pump unit, e) said pack including a plastic base and a foamed, compressible, plastic cover received on said base, the pump received in the cavity, in said base, f) and including a control means received in said foamed cover and connected with said pump unit, said control means accessible from the exterior of the cover for controlling the operation of the pump unit, g) there being a hole in said cover, and including serrated retainer means at a side of the control means to hold said means in said hole, said serrated retainer means having serrations gripped by the foamed plastic of the cover at the side of the hole.

57. Tub apparatus, comprising a) a foamed, compressible, plastic tub wall having an inner side and an outer side, the tub having an interior to receive liquid, and ports extending through said side wall, b) a plastic pack having a cavity formed therein, c) a pump unit received in said cavity and protectively enclosed by said plastic pack, d) and tubular duct means connected with said pump unit and extending from said cavity to said ports for circulating liquid between the tub interior and said pump unit, e) said pack including a plastic base and a foamed, compressible, plastic cover received on said base, the pump received in the cavity, in said base, f) and including a control means received in said foamed cover and connected with said pump unit, said control means accessible from the exterior of the cover for controlling the operation of the pump unit, g) and including a split in the wall of the foamed cover to pass external electrical wiring to the control means, there being a hole in said cover, the control means having shoulders compressively gripped by the foamed plastic of the cover at the side of the hole.

* * * * *